United States Patent [19]

Albright

[11] Patent Number: 4,844,294

[45] Date of Patent: Jul. 4, 1989

[54] VENDING MACHINE SHELF ASSEMBLY WITH DRIVE UNIT HELIX SAFETY LOCK

[75] Inventor: Henry J. Albright, West Des Moines, Iowa

[73] Assignee: Fawn Engineering Corp., Des Moines, Iowa

[21] Appl. No.: 117,222

[22] Filed: Nov. 5, 1987

[51] Int. Cl.[4] ..... G07F 11/36

[52] U.S. Cl. ..... 221/75; 221/197

[58] Field of Search ..... 221/75, 76, 197, 198; 222/333, 412, 413

[56] References Cited

U.S. PATENT DOCUMENTS

| | | | |
|---|---|---|---|
| 2,300,956 | 11/1942 | Mergens . | |
| 3,085,711 | 4/1963 | Holstein et al. . | |
| 3,178,055 | 4/1965 | Schuller . | |
| 3,269,595 | 8/1966 | Krakauer et al. . | |
| 3,344,953 | 10/1967 | Krakauer et al. . | |
| 3,441,174 | 4/1969 | Kenney . | |
| 3,591,045 | 7/1971 | Sturrock . | |
| 3,601,281 | 8/1971 | Schlaf . | |
| 3,653,540 | 4/1972 | Offutt . | |
| 3,737,071 | 6/1973 | Offutt et al. . | |
| 3,990,754 | 11/1976 | Pitel et al. . | |
| 3,993,215 | 11/1976 | Cox et al. . | |
| 4,023,704 | 6/1977 | Pitel et al. . | |
| 4,240,563 | 12/1980 | Lennartson . | |
| 4,280,745 | 7/1981 | Mitchell . | |
| 4,316,558 | 2/1982 | Kubiak | 222/327 |
| 4,506,802 | 3/1985 | Lotspeich . | |
| 4,600,119 | 7/1986 | Olson | 221/75 |
| 4,744,490 | 5/1988 | Albright et al. | 221/75 |

*Primary Examiner*—H. Grant Skaggs

*Attorney, Agent, or Firm*—Henderson & Sturm

[57] ABSTRACT

In a vending machine shelf arrangement, wherein a combined helix unit and drive unit are vertically slidably mounted within a vertical slot formed in a rear panel mounted on the base of the shelf, an assembly for preventing accidental axial separation of a helix unit from a drive unit which includes a first disc element mounted at the rear end of the helix unit adjacent the rear panel and frictionally gripping a drive connection of the helix unit with the drive unit, and a second lip element upstanding on the shelf base and also adjacent the rear panel, the disc element interposed between the lip element and the rear panel thereby preventing normal separation of the helix unit from the drive unit.

2 Claims, 2 Drawing Sheets

VENDING MACHINE SHELF ASSEMBLY WITH DRIVE UNIT HELIX SAFETY LOCK

TECHNICAL FIELD

The present invention relates to an article vending machine, and more particularly to an improved shelf assembly incorporating a drive unit helix safety lock.

BACKGROUND ART

The present invention relates to article vending machines wherein a plurality of vertically stacked, generally horizontally disposed and movable trays are provided for holding a plurality of articles to be vended thereon. Each shelf usually has a plurality of front-to-rear generally rectangular spaces or troughs spaced laterally across the shelf and with a helical coil mounted in each trough. Articles to be vended are positioned within convolutions of the coil such that, upon the rotation of a particular coil in response to actuation of a control mechanism, one of the articles is projected into a delivery opening where it is available to a purchaser.

Each helical coil, or helix, is connected to a drive unit for rotating the helix on the shelf or tray, and with the connection vertically slidably mounted within a slot formed in a panel extended laterally across the rear of the tray. To separate the helix from the drive unit, the helix is pulled forwardly therefrom, a frictional releasable engagement normally securing the helix to the drive unit. Such slidable mounting has greatly improved the efficiency of this type of vending machine tray.

DISCLOSURE OF THE INVENTION

Experience in the field has shown, however, that under certain circumstances, unforeseen and undesirable linear separation of the drive unit and the helix operatively connected thereto may accidentally occur, such that a structural means of obviating this type of separation is necessary to maintain the operating reliability of this type of tray arrangement.

The invention relates to a structural combination of elements for preventing a helix from linearly moving out of operative frictional engagement with a drive unit in the condition of the joined helix drive unit slidably mounted within a panel at the rear of a shelf or tray assembly. The invention is accomplished by providing a disc mounted concentrically with and at the rear end of the helix, in combination with an upwardly extended lip formed on the floor of the tray and spaced forwardly of the rear panel, whereby when assembled in operating condition, a peripheral portion of the disc is disposed between the rear panel and the lip such that axial relative movement between the helix and the drive unit is prevented, permitting however normal vertical movement of the combined drive unit and helix within the loading slot.

It is therefore an object of this invention to provide an improved shelf or tray arrangement for a vending machine.

It is another object of this invention to provide a vending machine shelf with a plurality of combined helical coils and drive units, each of which is slidably mounted within a slot formed in a rear panel on the shelf, and wherein means is provided for maintaining each helical coil in frictional engagement with a drive unit therefore.

Another object of this invention is to provide a vending machine shelf having one or more combined helix and drive units, wherein the helix is frictionally engaged with a drive unit and further wherein co-actingmeans is provided for maintaining the frictional engagement between each helix and drive unit.

BRIEF DESCRIPTION OF THE DRAWINGS

These and other objects of the invention will become readily apparent upon a thorough study and review of the following detailed description of the preferred embodiment for carrying out the invention, particularly when viewed in conjunction with the accompanying drawings, wherein.

BEST MODE FOR CARRYING OUT THE INVENTION

Figure 1:
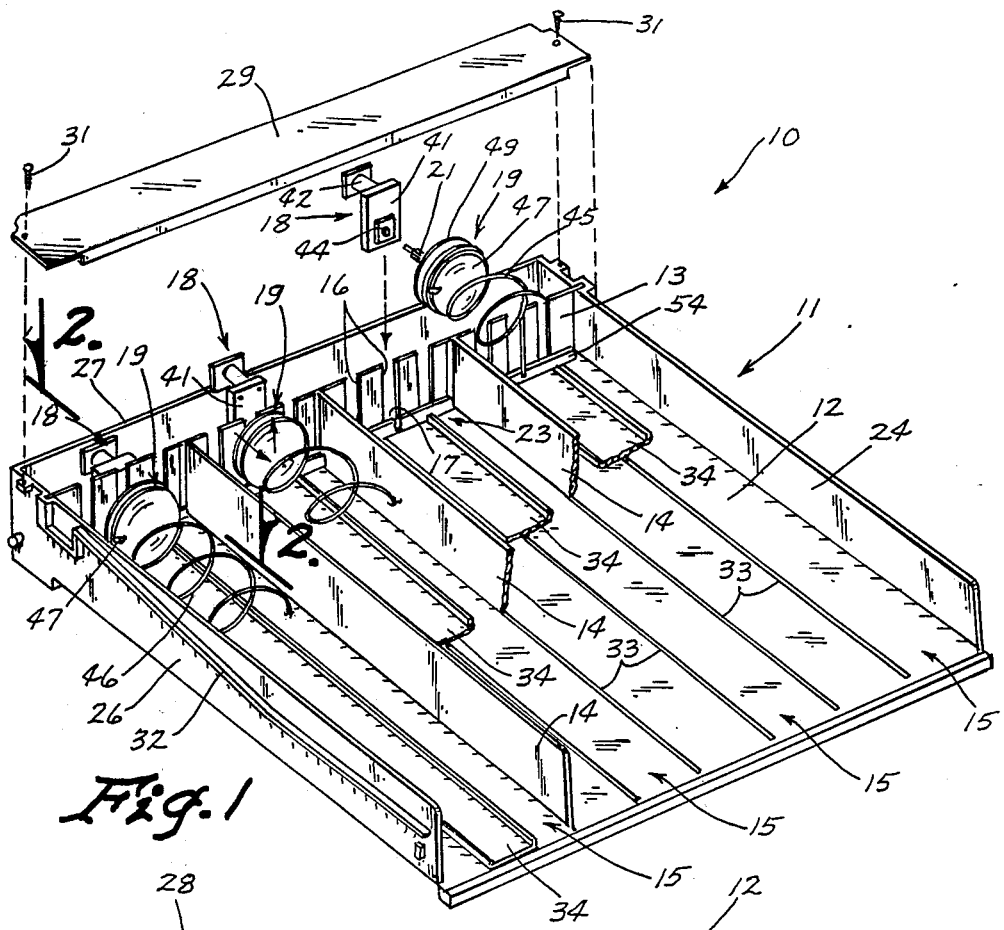
FIG. 1 is a perspective view of the vending machine shelf arrangement of this invention, with certain parts broken away and others shown in exploded view for clarity of the invention.

Referring now to the drawings, the shelf or tray assembly of this, invention is indicated generally at (10) in FIG. 1, which tray assembly (10) is utilized in any conventional automatic vending machine (not shown). This type of vending machine includes a box-like housing or casing which is mounted on legs or rollers, and which has a hinged door for maintaining the casing in either a closed, vending condition, or in an open, servicing condition. Within the casing are mounted a plurality of tray assemblies (10), which assemblies (10) carry products (not shown) for discharge into a delivery drawer of the vending machine, and which tray assemblies (10) are normally vertically spaced and horizontally slidable between an inner vending position and an extended position for servicing and loading purposes. This type of vending machine is shown in co-pending application entitled "Vending Machine Shelf Assembly", Ser. No. 06/899,651 filed Aug. 25, 1986.

The tray assembly (10) of this invention comprises a tray (11) which has a base (12) with a rear panel (13) slidably mounted thereon, and a plurality of laterally spaced, longitudinally extended divider members (14) mounted on the base (12) to form a plurality of longitudinally extended product feed troughs (15). The rear panel (13) is provided with a plurality of vertically formed, horizontally and laterally spaced slots (16), each slot (16) open at its top and closed at the bottom (17) (FIG. 3) thereof.

A drive unit (18) (FIG. 1) is provided for each trough (15) and is slidably engaged within one of the slots (16) centrally of a trough (15).

Figure 2:
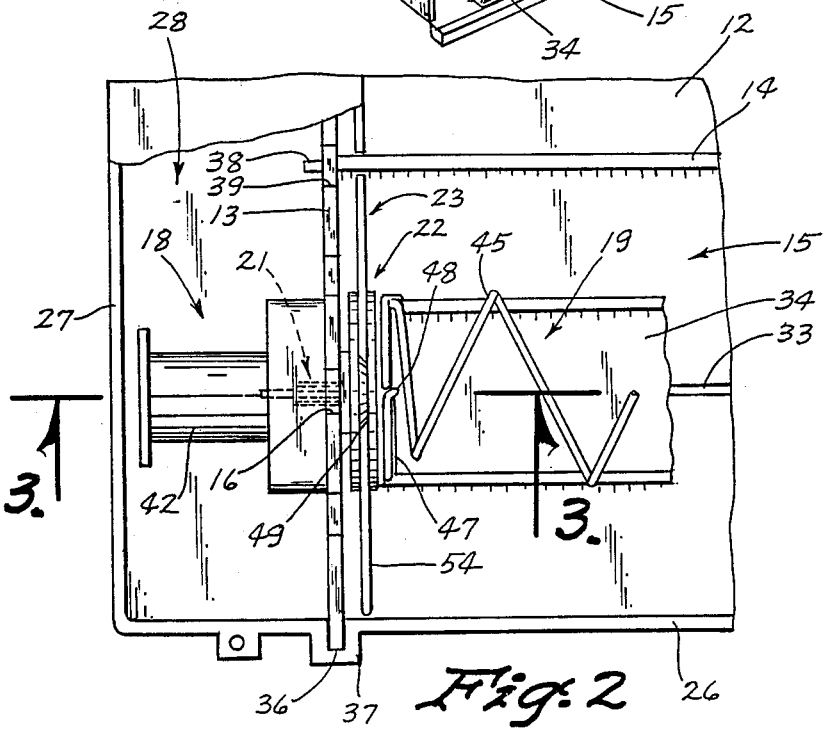
FIG. 2 is a greatly enlarged top plan view of a portion of FIG. 1.

To deliver a product to the front of the base (12), then off the base (12) and into a delivery drawer (not shown), a helix unit (19) is provided for each trough (15), which helix unit (19) is disposed longitudinally within a feed trough (15) and which includes a drive shaft (21) operatively connected with a respective drive unit (18) mounted on the rear panel (13) directly behind the respective helix unit (19) (FIG. 2).

To prevent axial, longitudinal separation of a drive unit (18) and a helix unit (19) (FIG. 4), means is provided which includes a first unit (22) mounted on the helix unit (19), and a second unit (23) mounted on the tray (11), the first and second units (22) and (23), respectively, operating in conjunction with each other to not only prevent linear separation of a combined drive unit (18) and helix unit (19), but also to permit vertical sliding movement of the combined drive unit (18) and helix unit (19) within a slot (16) for loading and unloading purposes.

More particularly, the tray assembly (10) includes further the tray (11) having a pair of laterally spaced side plates (24), (26) and a back plate (27) which is spaced rearwardly of the rear panel (13) to provide a space (28) (FIG. 3) therebetween to receive portions of the drive unit (18). An elongated cover (29) (FIG. 1) is provided for covering the space (28), fasteners (31) being provided for securing the cover (29) to the tray (11). A runner (32) is formed on the outside of each side plate (24), (26) for slidable insertion with co-acting means into the interior of the vending machine cabinet (not shown). Furthermore, a slit (33) is formed centrally of and running longitudinally at the side of each trough (15), each slit (33) being formed in the base (12) of the tray (11), for removably receiving either a divider member (14) or a subfloor (34) (FIG. 1), the subfloor (34) utilized to aid in maintaining each helix unit (19) centrally of its trough (15) for efficacy of moving products forwardly and outwardly of each trough (15).

To slidably mount the rear panel (13) downwardly on the tray base (12), a pair of slots (36) (FIGS. 1 and 2) are formed in embossments (37) formed rearwardly of each side plate (24) and (26). Additionally, to mount the T-shaped end (38) (FIG. 2) of each divider member (14) in the rear panel (13), additional slots (39) are vertically formed at spaced locations in the rear panel (13) such that the divider members (14) are also vertically, slidably removable relative to the rear panel (13) for assembly and servicing purposes.

Each drive unit (18) includes a housing (41) for mounting a drive motor (42), which housing (41) includes internal gearing (43) (FIG. 3) for driveably receiving the drive shaft (21) of the helix unit (19) in an axial manner. Each drive unit (18) is further provided with a mounting plate (44) (FIG. 1) of a size to be quickly and easily slid downwardly within a respective slot (16) (FIG. 4) to a seated position at the bottom (17) thereof. Each mounting plate (44) has a passage (44*a*) formed therein for passage therethrough of the drive shaft (21).

The helix unit (19) includes further an elongated helical coil (45) with windings (46) of sufficient spacing to receive product therebetween, including further a circular plate (47) (FIG. 3) mounted at the rear end of the coil (45) and secured to the coil (45) by means of an inturned lug (48) (FIG. 2) wedged with the plate (47).

Figure 3:
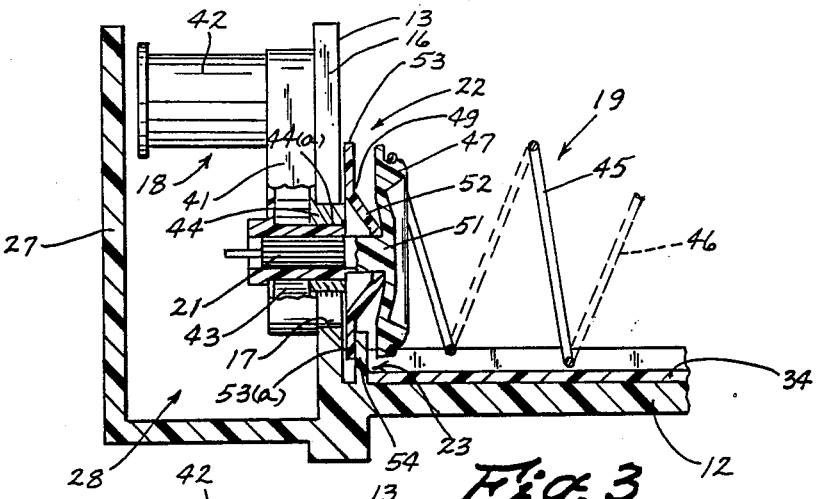
FIG. 3 is a vertical, sectional view taken along the line 3—3 in FIG. 2.

The first unit (22) includes further a circular disc (49) (FIG. 3) which has a central opening (51) formed therein whereby the disc (49) frictionally receives and embraces the drive shaft (21), a conical portion (52) of the disc (49) being contiguous with the plate (47), and a flattened outer peripheral portion (53) of the disc (49) being contiguous with the rear panel (13) in the assembled position of the first unit (22) (FIG. 3).

Figure 4:
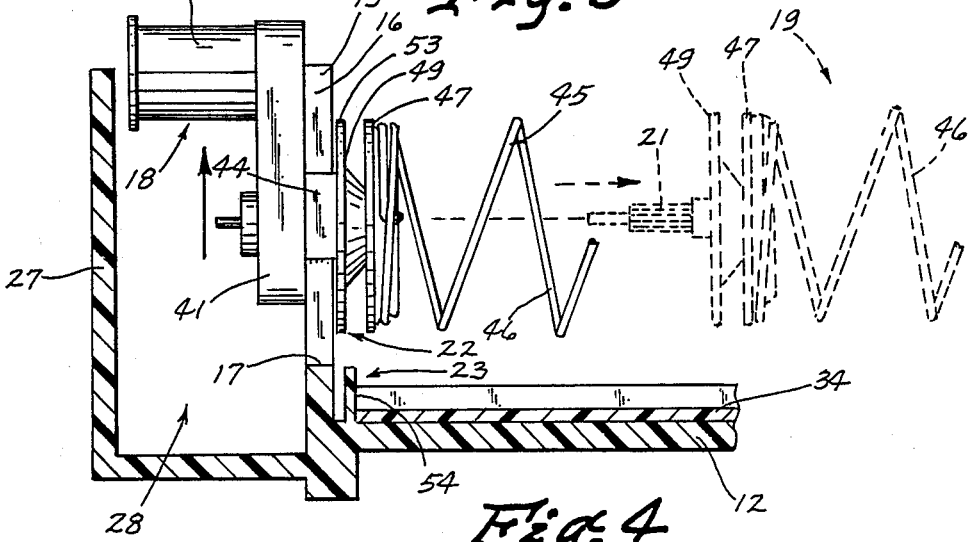
FIG. 4 is a view similar to FIG. 3, and showing certain parts thereof in alternate positions.

The second unit (23) comprises in particular an upstanding lip element (54) (FIGS. 2 and 3) which is mounted on and integral with the base (12), extended laterally across each trough (15) of the base (12), and which lip element (54) is disposed adjacent the rear panel (13), being spaced slightly forwardly therefrom as best indicated in FIGS. 3 and 4.

Referring particularly to FIGS. 3 and 4, it is readily seen that when the first and second units (22) and (23) are in their assembled condition of the drive unit (18) and the helix unit (19), a peripheral portion (53(a)) (FIG. 3) of the disc (49) is interposed between and contiguous with both the lip element (54) and the rear panel (13) whereby axial, longitudinal separation of the helix unit (19) from the drive unit (18) is prevented due to the frictional grip of the disc (49) with the drive shaft (21); however, as best shown in FIG. 4, vertical sliding movement of the combined helix unit (19) and drive unit (18) is not prevented whereby such vertical movement is permissible for loading and unloading purposes of each combined drive unit (18) and helix unit (19).

While the invention has been described with reference to a preferred embodiment, changes and/or modifications may be suggested to those skilled in the art without the parting from the inventive concept or scope of the appended claims.

I claim:

1. For use in a vending machine, an improved tray assembly comprising:

a tray having a base, a rear panel mounted on said base, and divider members mounted on said base in parallel, laterally spaced relationship to form longitudinally disposed product feed troughs over said base;

said rear panel having a plurality of vertically disposed, laterally spaced slots formed therein, one or more said slots open at the top thereof and closed at the bottom;

a drive unit slidably engaged within one of said slots;

a helix unit disposed longitudinally within a feed trough and comprising a helical coil secured at a rear end to a circular plate including a drive shaft connected to said plate and operatively connected with said drive unit for receiving drive therefrom;

first means mounted on said helix unit, and comprising a circular disc detachably mounted on said shaft, spaced rearwardly of said plate and disposed adjacent said rear panel; and second means mounted on said tray and operable in conjunction with said first means to prevent linear separation of said helix unit from said drive unit while permitting vertical movement within said one slot of said helix unit combined with said drive unit, said second means comprising a lip element mounted on said base in an upstanding manner and disposed adjacent said rear panel, and further wherein a portion of said disc is interposed between and contiguous with both said lip element and said rear panel whereby to prevent longitudinal axial movement while permitting rotational movement of said helix unit relative to said drive unit.

2. The invention claim 1, and further wherein said disc has a central opening therein for receiving and frictionally gripping said drive shaft and having a conical shape the periphery of which is spaced from said plate whereby to receive said lip element between said disc periphery and said plate.

* * * * *